United States Patent [19]

Sano

[11] Patent Number: 4,881,478

[45] Date of Patent: Nov. 21, 1989

[54] DEVICE FOR ATTACHING ELECTRONIC CIRCUIT PLATE OF COMPUTER-OPERATED SEWING MACHINE

[75] Inventor: Yasuro Sano, Tokyo, Japan

[73] Assignee: Janome Sewing Machine, Tokyo, Japan

[21] Appl. No.: 183,625

[22] Filed: Apr. 22, 1988

[30] Foreign Application Priority Data

Apr. 24, 1987 [JP] Japan ..... 62-99695

[51] Int. Cl.[4] ..... D05B 3/02

[52] U.S. Cl. ..... 112/259; 112/445; 112/457; 312/257.1; 361/394

[58] Field of Search ..... 112/453, 454, 259, 455–458; 312/257 A, 204; 361/354, 376, 393, 394

[56] References Cited

U.S. PATENT DOCUMENTS

| | | | |
|---|---|---|---|
| 2,928,998 | 3/1960 | Brumfield | 361/376 |
| 3,097,326 | 7/1963 | Cole et al. | 361/354 |
| 3,325,693 | 6/1967 | Stanback | 361/354 |
| 4,203,378 | 5/1980 | Giesselmann et al. | 112/457 |
| 4,290,377 | 9/1981 | Hanyu et al. | 112/453 |
| 4,602,583 | 7/1986 | Hanyu | 112/454 |
| 4,817,547 | 4/1989 | Gaeumann et al. | 112/458 X |

*Primary Examiner*—Andrew M. Falik

*Attorney, Agent, or Firm*—Michael J. Striker

[57] ABSTRACT

In a computer-controlled sewing machine including a standard machine frame and exchangeable electronic control circuit plates inclusive of an operation board, a case for receiving a control circuit plate is attached to the machine frame. The circuit plates and the case are provided with coded keying means in the form of pins and holes to guarantee the fastening of a control plate matching a particular model of the sewing machine.

2 Claims, 3 Drawing Sheets

DEVICE FOR ATTACHING ELECTRONIC CIRCUIT PLATE OF COMPUTER-OPERATED SEWING MACHINE

BACKGROUND OF THE INVENTION

The present invention relates to a device for attaching the electronic circuit plate of a computer-operated sewing machine.

In conventional computer-operated sewing machines, it has been the real situation that a machine frame having an arm and a bed, an operation panel, an electronic circuit plate, etc. are designed for each model. Accordingly, machine frames, operation panels, electronic circuit plates, etc. of different specifications must be prepared for respective models.

As an improvement, it has been proposed that a modified operation panel and modified electronic circuit plate constructed as a unit be mounted on the machine frame of a certain sewing machine, thereby to change the model of the sewing machine. In actuality, however, standard machine frames are used in a manufacturing plant, and hence, an assembly worker might mistake the modified operation panel unit prepared for each model and assemble a different unit.

The conventional method of production wherein the machine frames, the operation panels, the electronic circuit plates, etc. are prepared for the respective models, has the disadvantage that the sewing machines become costly. On the other hand, the method employing the operation panel units prepared for the respective models has the disadvantage that the sewing machines might be assembled erroneously.

SUMMARY OF THE INVENTION

An object of the present invention is to eliminate the aforementioned disadvantages of the known methods.

The present invention consists in that the machine frames of sewing machines of different models are made standard, thereby to curtail the casting cost, machining cost and assembling cost of the sewing machines, and that a circuit plate-attaching device having coded keying means is provided, thereby to prevent the occurrence of the mistaken assemblage of an operation panel unit of an incorrect model due to the misunderstanding of an assembly worker in handling.

More specifically, in assembling operation panels of the different models in the case where the machine frames are made common for the multifarious sewing machines of the different models, if a drive control circuit plate mounted earlier and the operation panel to be mounted later agree with the desired model, they are smoothly assembled by using the coded keying means which include positioned pins and holes provided between the plate and the panel, whereas if they disagree with the correct model, the assemblage is hindered by the keying means. It is therefore possible to prevent the assemblage of the components of incorrect types due to the mistake of the worker.

BRIEF DESCRIPTION OF THE DRAWINGS

The drawings illustrate an embodiment of the present invention, wherein.

DESCRIPTION OF THE PREFERRED EMBODIMENT

Figure 1:
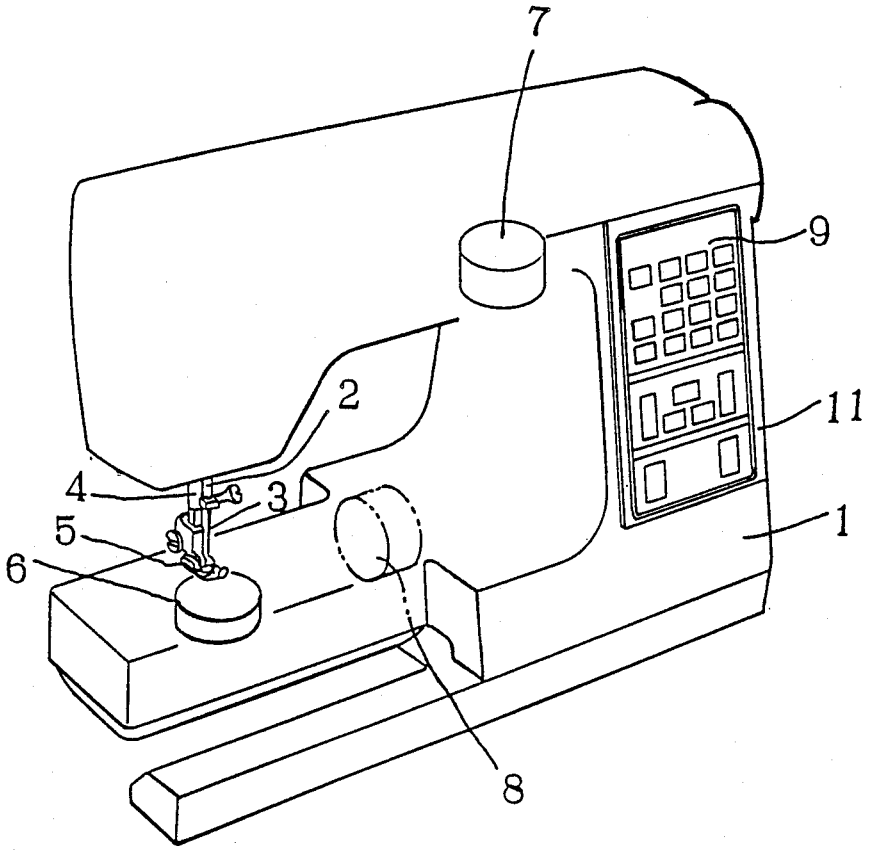
FIG. 1 is an exterior view of a sewing machine to which the present invention is applied.
Figure 2:
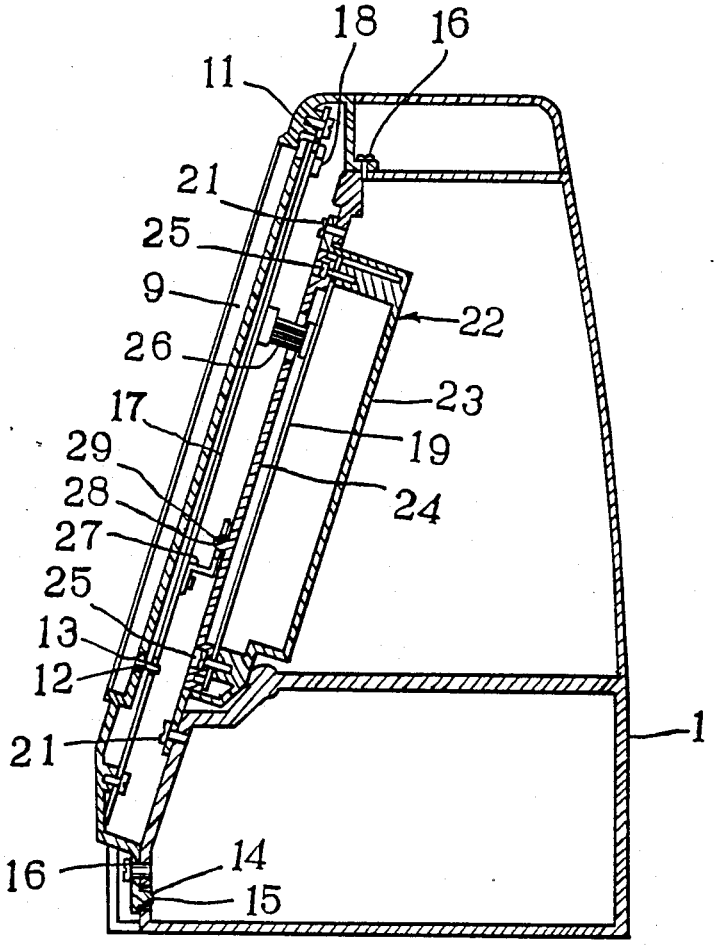
FIG. 2 is a sectional side view of an embodiment of an attachment device showing the essential features of the present invention.

An embodiment of the present invention will be described with reference to the drawings. Numeral 1 indicates a machine frame, in which an arm frame and a bed frame are united. A needle bar 2 is supported by the arm frame so as to be capable of reciprocal movements in the vertical direction and swing movements in the horizontal direction, and it has a needle 3 set at its lower end. A presser bar 4 is supported by the arm frame so as to be vertically slidable, and a presser foot 5 for pressing fabric is mounted on the lower end of the presser bar 4. Shown at numeral 6 is a loop taker of horizontal full rotation which is rotatably supported by the bed frame. A hook (not shown) is formed at a suitable outer-peripheral part of the loop taker 6, and a bobbin (not shown) around which a lower thread is wound is installed inside the loop taker 6. This loop taker 6 is rotated in synchronism with the vertical movements of the needle bar 2 so as to take an upper thread held by the needle 3, whereby the upper thread is interlinked with the lower thread included in the loop taker 6. A first stepping motor 7 serves to control the amplitude of the movements of the needle bar 2, while a second stepping motor 8 serves to control the movement of a feed dog (not shown) for fabric feed. Numeral 9 denotes an operating keyboard, which holds a pattern indication circuit plate 10 therein. The operating keyboard 9 is supported so as to be fitted in the recess of an operation panel 11, thereby to be mounted on the front face of the machine frame 1.

Figure 3:
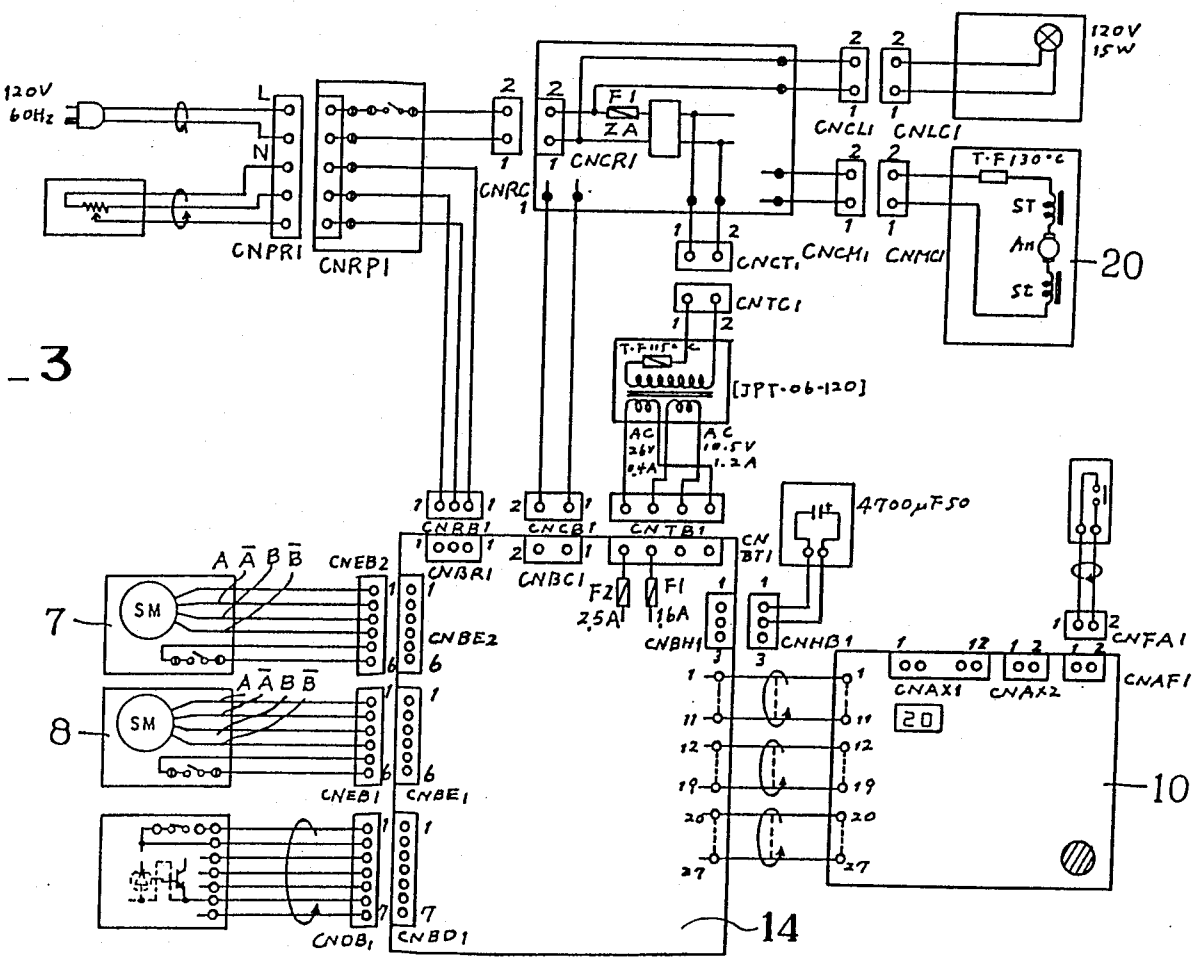
FIG. 3 is a circuit diagram for elucidating the embodiment electronic control circuits in a sewing machine of the present invention.

A structure for supporting and attaching the operating keyboard 9 on the operation panel 11, includes a first code set consisting of a pin 12 projecting from the keyboard 9 and a hole 13 formed in the operation panel 11. The pin and the hole are positioned for each model such as to snugly fit in with one another, while bolts (not shown) attached to in the operating keyboard 9 are inserted through corresponding holes of the operation panel 11 and secured by nuts (not shown) so as to fasten the two components 9 and 11 together. In addition the operation panel 11 is mounted on the machine frame 1. In this regard, a second code set consisting of a pin 14 formed on the operation panel 11 and a hole 15 formed in the machine frame 1, are positioned for each model such as to snugly fit in with one another, while screws 16, 16 are tightened to fix the two components 11 and 1. Numeral 17 denotes a CPU (central processing unit) circuit plate which is principally composed of control circuits for controlling the stepping motors 7 and 8. The CPU circuit plate 17 is screwed to the back of the operation panel 11, and is electrically connected with the pattern indication circuit plate 10 (FIG. 3) of the operating keyboard 9 by a connector 18.

Numeral 19 designates a control circuit plate for a drive motor 20 which is supported in the machine frame 1. The drive motor control circuit plate 19 is held in a circuit plate case 22 which is fixed to the machine frame 1 by screws 21, 21. This circuit plate case is made up of a case body 23 and a case cover 24, and along with the case cover 24, the drive motor control circuit plate 19 is fixed to the case body 23 by screws 25, 25. The drive motor control circuit plate 19 and the CPU circuit plate 17 are electrically connected by a connector 26.

Numeral 27 designates a Z-shaped spacing member which at its lower part is screwed to the rear surface of the CPU circuit plate 17, and at its upper part which is opposed to the surface of the cover 24 of the circuit plate case 22 extends in parallel therewith. A third code set consisting of a pin 28 projecting from the case cover 24 and a hole 29 formed in the upper part of spacing member 27 are positioned for each model such as to snugly fit in with one another.

Since the attaching device according to the present invention is constructed with the code sets as described above, it is possible that the machine frames 1 are made common for various machine types of different models, while the specifications of the operating keyboards 9 are changed for the respective models. In this example, the drive motor control circuit plate 19 and the operation panel 11 to be combined for each model are assembled to the machine frame in the order mentioned. Consequently, even when an assembly worker tries to assemble the operation panel 11 of an incorrect model to the drive motor control circuit plate 19 having been assembled to the machine frame 1 earlier, the third code set which consists of the pin 28 and the hole 29 provided between the operation panel 11 and the circuit plate case cover 24 and positioned for each model and the second code set which consists of the pin 14 and the hole 15 provided between the machine frame 1 and the operation panel 11 and positioned for each model, do not come into coincidence, that is, the pins and the holes are not snugly fitted. Therefore, the assembly worker fails to mount the operation panel 11 and immediately notices the mistaken assemblage. It is accordingly prevented to erroneously assemble the operation panel 11 of the incorrect model.

As described above, by virtue of the coded keying means according to the present invention, the mistaken assemblage of erroneous components can be prevented from occurring in a workshop for assembling various types of computer-operated sewing machines, which feature is very greatly effective in the industry.

What is claimed is:

1. In a computer-operated sewing machine having a standard machine frame which includes an arm and a bed, a needle bar which is supported in the machine frame and which performs vertical and horizontal reciprocal movements, a loop taker which is rotatably supported on the machine frame and which interlinks upper and lower threads in association with a needle fixed to the needle bar, a drive motor which moves the loop taker and the needle bar, stepping motors which control the movements of the needle bar and fabric feed, and a computer control portion which delivers control data to the stepping motors, a device for attaching electronic plates of different models of the computer-operated sewing machine, comprising a circuit plate case which holds a control circuit plate for said drive motor and which is fixed to said machine frame, an operational panel which holds an operating keyboard for an operator and a control circuit plate for said computer control portion and which is fixed to said machine frame, and coded keying means composed of pins and holes positioned for each model of the sewing machine and provided between said operation panel and said machine frame and between said operation panel and said circuit plate case.

2. In a computer-operated sewing machine as defined in claim 1, said coded keying means including a first code set arranged between said operating keyboard and said operation panel, a second code set arranged between said operation panel and said machine frame, and a third code set arranged between said control circuit plate for the computer control portion and said circuit plate case, and each of said code sets consisting of a pin and a hole fitting in with one another for the respective models.

* * * * *